US006303842B1

(12) United States Patent
Bridges et al.

(10) Patent No.: US 6,303,842 B1
(45) Date of Patent: Oct. 16, 2001

(54) METHOD OF PRODUCING OLEFINS FROM PETROLEUM RESIDUA

(75) Inventors: Robert S. Bridges, Friendswood; Richard B. Halsey, Houston; Don H. Powers, McKinney, all of TX (US)

(73) Assignee: Equistar Chemicals, LP, Houston, TX (US)

( * ) Notice: Subject to any disclaimer, the term of this patent is extended or adjusted under 35 U.S.C. 154(b) by 0 days.

(21) Appl. No.: 09/544,306

(22) Filed: Apr. 6, 2000

Related U.S. Application Data

(63) Continuation of application No. 08/951,041, filed on Oct. 15, 1997, now abandoned.

(51) Int. Cl.[7] ..... C07C 4/04; C10G 9/00

(52) U.S. Cl. ..... 585/648; 585/649; 585/650; 585/251; 208/86; 208/130; 208/309

(58) Field of Search ..... 208/85, 86, 309, 208/61, 89, 130, 211; 585/251, 648, 649, 650

(56) References Cited

U.S. PATENT DOCUMENTS

| | | | | |
|---|---|---|---|---|
| 2,093,843 | | 9/1937 | McKee | 208/57 |
| 2,666,734 | | 1/1954 | Findlay | 196/120 |
| 2,736,685 | | 2/1956 | Wilson et al. | 196/50 |
| 2,846,360 | | 8/1958 | Jahnig | 196/49 |
| 2,904,502 | | 9/1959 | Shapleigh | 208/130 |
| 2,925,374 | | 2/1960 | Gwin et al. | 208/86 |
| 3,329,605 | | 7/1967 | Tokuhisa et al. | 208/130 |
| 3,513,217 | | 5/1970 | Raymond | 585/251 |
| 3,598,720 | | 8/1971 | Stolfa | 208/89 |
| 3,720,729 | | 3/1973 | Sze et al. | 208/57 |
| 3,781,195 | | 12/1973 | Davis et al. | 208/57 |
| 3,855,113 | * | 12/1974 | Gould | 208/89 |
| 3,855,339 | | 12/1974 | Hosoi et al. | 260/683 R |
| 3,862,898 | | 1/1975 | Boyd et al. | 208/73 |
| 3,898,299 | | 8/1975 | Jones et al. | 585/251 |
| 4,039,429 | * | 8/1977 | van Klinken et al. | 208/50 |
| 4,119,531 | | 10/1978 | Hopkins et al. | 208/251 H |
| 4,126,538 | | 11/1978 | Goudriaan et al. | 208/80 |
| 4,210,520 | * | 7/1980 | Wernicke et al. | 208/57 |
| 4,212,729 | | 7/1980 | Hensley, Jr. et al. | 208/210 |
| 4,235,702 | * | 11/1980 | Smith | 208/87 |
| 4,239,616 | | 12/1980 | Gearhart | 208/309 |
| 4,257,871 | | 3/1981 | Wernicke et al. | 208/57 |
| 4,297,204 | | 10/1981 | Schliebener et al. | 208/95 |
| 4,297,242 | | 10/1981 | Hensley, Jr. et al. | 502/220 |
| 4,310,409 | | 1/1982 | Wernicke et al. | 208/57 |
| 4,324,935 | | 4/1982 | Wernicke et al. | 585/314 |
| 4,391,700 | * | 7/1983 | Billon et al. | 208/86 |
| 4,400,264 | * | 8/1983 | Kwant et al. | 208/68 |
| 4,405,441 | * | 9/1983 | Van Dongen et al. | 208/61 |
| 4,447,313 | * | 5/1984 | Gorring et al. | 208/86 |
| 4,479,869 | | 10/1984 | Petterson et al. | 208/130 |
| 4,492,624 | | 1/1985 | Johnson et al. | 208/78 |
| 4,498,629 | | 2/1985 | Grondman | 239/434.5 |
| 4,500,416 | * | 2/1985 | van Dongen et al. | 208/86 |
| 4,522,710 | * | 6/1985 | Achia et al. | 208/349 |
| 4,534,852 | | 8/1985 | Washecheck et al. | 208/89 |
| 4,548,706 | | 10/1985 | Papadopoulos et al. | 208/130 |
| 4,552,644 | | 11/1985 | Johnson et al. | 208/78 |
| 4,615,795 | * | 10/1986 | Woebcke et al. | 208/72 |
| 4,619,757 | * | 10/1986 | Zimmerman | 208/57 |
| 4,673,486 | * | 6/1987 | Orihashi et al. | 208/86 |
| 4,686,028 | | 8/1987 | Van Driesen et al. | 208/86 |
| 4,752,376 | | 6/1988 | Pachano et al. | 208/86 |
| 4,762,958 | | 8/1988 | Martens et al. | 585/613 |
| 4,777,318 | | 10/1988 | Martens et al. | 585/613 |
| 4,786,400 | | 11/1988 | Farnsworth | 208/80 |
| 4,906,442 | | 3/1990 | Johnson et al. | 422/188 |
| 5,120,892 | | 6/1992 | Skraba | 585/652 |
| 5,190,634 | | 3/1993 | Fernandez-Baujin et al. | 208/107 |
| 5,714,663 | | 2/1998 | Serrand et al. | 585/648 |

FOREIGN PATENT DOCUMENTS

| | | |
|---|---|---|
| 27 21 504 A1 | 11/1978 | (DE) . |
| 0 102 594 A2 | 8/1983 | (EP) . |

OTHER PUBLICATIONS

Wernicke, et al., Pretreat feed for more olefins, Oct. 1979, pp. 137–142, *Hydrocarbon Processing*.

Hydrocarbon Processing, Nov. 1986, *Hydrocracker feed olefin unit*, A.G. Goossens, Shell Int. Chemie Mij. BV, The Hague, The Netherlands.

* cited by examiner

*Primary Examiner*—Walter D. Griffin
(74) *Attorney, Agent, or Firm*—Kevin M. Carroll

(57) ABSTRACT

Olefins may be produced by thermally steam cracking residuum containing a short residuum having a boiling point range greater than 565° C. wherein at least 3 weight percent of the short residuum has a boiling point greater than or equal to 650° C. The residuum has pentane insolubles less than or equal to 1.2, ASTM 893. Further, the weight percent of hydrogen of the residuum is greater than or equal to 12.5. Such feedstocks are produced by hydrotreating, where necessary, a petroleum residuum having pentane insolubles less than 1.0, ASTM 893, until the weight percent of hydrogen of the petroleum residuum is 12.5. Where necessary, the petroleum residuum may be deasphalted prior to subjecting it to hydrotreatment.

2 Claims, 4 Drawing Sheets

METHOD OF PRODUCING OLEFINS FROM PETROLEUM RESIDUA

This is a continuation of application Ser. No. 08/951,041, filed Oct. 15, 1997 now abandoned.

FIELD OF THE INVENTION

The invention relates to a method of producing feedstocks for use in olefin production from petroleum residuum having a boiling point in the general range of about 340° to about 750° C. at atmospheric pressure. The, petroleum residuum contains short residuum that has a boiling point greater than 565° C. Up to 100 weight percent of the short residuum has a boiling point greater than or equal to 650° C. The invention further relates to a method of producing olefins from such feedstocks.

BACKGROUND OF THE INVENTION

Crude oils have various percentages of atmospheric residuum, sometimes called long residuum, which exhibit a boiling point of from about 340° C. to a final boiling point, generally in excess of 650° C. A "heavy crude" is a crude oil having a high percentage of atmospheric residuum as well as having a high percentage of short residuum. Short residuum, or vacuum residuum, is defined as that portion of the crude oil which has a boiling point of from about 565° C. to the final boiling point of the crude oil.

The short residuum contained in such crudes generally contain relatively high Conradson carbon residue precursors, and/or asphaltenes, as well as, in many cases, high sulfur, nitrogen and metals. Examples of heavy, low-sulfur crude oils include the Western African crudes (such as Cabinda and Takula) and various Pacific Rim crudes such as Daqing). Examples of heavy, high-sulfur crudes include the Venezuelan crudes (such as Boscan, Bachaquero and Merey), Canadian crudes (such as Cold Lake and Lloydminster) and Mexican crudes (such as Maya).

Ethylene and propylene—basic intermediates in the production of polyolefins—are typically obtained by thermal steam cracking (pyrolysis) of natural gas liquids (ethane, propane and butane) or petroleum distillates (gasoline, condensates, naphtha and gas oil). As the worldwide demand for such light olefins increases, it has become highly favorable to use heavier feedstocks. In the last twenty years, processes have been developed to utilize higher boiling point distillates as olefin feedstocks.

In general, the use of higher boiling point olefin feedstocks require increased capital investment in the olefins plant. As the boiling point of naturally-occurring feedstock components rises, the olefins cracking yield patterns shifts from 70+ weight percent ethylene (for an ethane feed) to less than 30 weight percent ethylene (for naphtha and gas oil feeds). The higher boiling point feeds exhibit greater fouling tendencies in the pyrolysis furnaces, requiring additional furnace capacity to produce the same ethylene volume, and produce a greater yield of coproducts per yield of ethylene, requiring additional capacity in the reaction quench and separation section downstream of the pyrolysis furnaces.

The qualities desirable for the production of ethylene, propylene and higher-valued coproducts from olefin feedstocks (such as hydrogen content) generally decrease with increasing boiling point and undesirable qualities (sulfur, nitrogen, metals, polynuclear aromatics and asphaltene content) generally increase with increasing boiling point.

Olefin units capable of feeding naphthas and/or gas oils are relatively common, depending on local feedstock price and availability and coproduct value and demand. Olefin units capable of feeding higher boiling point streams (having a boiling point with the general range of 340° C. to about 565° C.) are also known.

U.S. Pat. No. 3,781,195 to Davis discloses a method for hydrotreating distillates having a boiling point of between 300° to 650° C. prior to subjecting the distillate to thermal cracking with steam at 700° to 1000° C. The distillates are prepared by vacuum flash distillation, with the highest boiling portion of the vacuum tower feed ("vacuum residuum") being rejected from the flash distillate. Asphaltenes which do not thermally crack but instead deposit as coke on the cracking furnace tubes, are removed in the vacuum residuum, along with a portion of the vacuum tower feed which would thermally crack to produce desirable olefins. The vacuum residuum is generally sold at a fuel value. Davis further discusses pretreatment of the distillate feedstock with hydrogen in the presence of a catalyst in order to reduce the content of aromatics, sulfur, nitrogen and metal compounds.

U.S. Pat. No. 4,257,871 to Wernicke discloses a process for the production of olefins by first deasphalting a vacuum residue and then, prior to hydrogenation, blending the deasphalted vacuum residue with a vacuum gas oil. The hydrotreatment employed in this process is known in the industry as hydrocracking. Hydrocracking produces a high yield of lower boiling distillates which are generally sold into the refined product fuels market. Only about 20 percent of the hydrogenated product has a boiling point in excess of 340° C. The noted particularly active hydrogenation catalyst disclosed in Wernicke contains silica that is used to promote hydrocracking by providing acid sites for these reactions. Hydrocracking is defined as the breaking of carbon to carbon single bonds that are then saturated with hydrogen. These reactions primarily occur at tertiary carbon sites present in saturated polynaphthene hydrocarbons and less frequently at secondary carbon sites present in linear or paraffinic hydrocarbons. Hydrocracking will not typically occur at carbon to carbon double or triple bonds.

SUMMARY OF THE INVENTION

It is an object of this invention to provide a process for producing olefins from an olefin feedstock containing a short residuum having a boiling point greater than 565° C.; up to about 100 weight percent of the short residuum having a boiling point greater than or equal to 650° C. The olefin feedstock has pentane insolubles, ASTM D-893, less than or equal to 1.2, and a hydrogen content in excess of 12.5 weight percent.

Another embodiment of the invention is directed to the economic production of an olefin feedstock from heavier hydrocarbon fractions containing short residuum having a boiling point greater than 565° C.; up to about 100 weight percent of the short residuum having a boiling point greater than or equal to 650° C. The olefin feedstock further has pentane insolubles, ASTM D-893, less than or equal to 1.2 and a hydrogen content in excess of 12.5 weight percent.

In accordance with the invention, petroleum residuum containing short residuum (wherein up to about 100 weight percent of the short residuum has a boiling point greater than or equal to 650° C.); the pentane insolubles of the petroleum residuum being less than or equal to 1.2, ASTM D-893, may be subjected to hydrotreatment at high pressure, to produce an olefin feedstock having a hydrogen content in excess of 12.5 weight percent. Effort is made to minimize cracking during the hydrotreatment stage.

Still in accordance with the invention, petroleum residuum containing short residuum (up to about 100 weight percent of the short residuum having a boiling point greater than or equal to 650° C.) may be subjected to deasphalting until the pentane insolubles are less than or equal to 1.2, ASTM D-893. If necessary, the deasphalted residuum may then be subjected to hydrotreatment for a time sufficient until the hydrogen content is at least 12.5 weight percent.

DETAILED DESCRIPTION OF THE INVENTION

Figure 1:
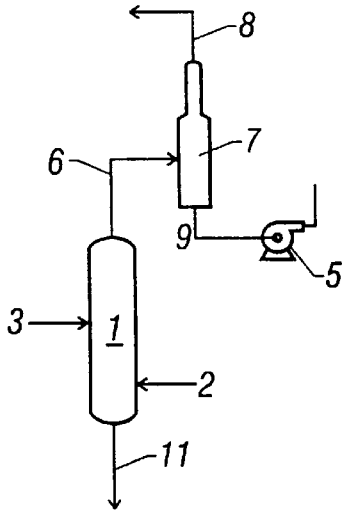
FIG. 1 is a schematic flow diagram showing the deasphalting chamber for use in the invention.

Olefins are produced in accordance with the invention from atmospheric petroleum residuum. Atmospheric petroleum residuum, or "long" residuum, as used herein refers to the bottom fraction produced from the atmospheric-pressure distillation of crude oil feedstocks. Typically, atmospheric petroleum residuum has a boiling point from about 340° C. to the final boiling point of the crude oil.

The term "crude oil feedstock" as used herein denotes the full range of crude oils from primary, secondary or tertiary recoveries of conventional or offshore oil fields as well as the myriad of feedstocks derived therefrom. "Crude oil feedstocks" may also be "syncrudes" such as those that can be derived from coal, shale oil, tar sands and bitumens. The crude oil feedstock may be virgin (straight run) or generated synthetically by blending.

Further, the term "crude oil feedstocks" is intended to include the component parts of crude oils such as residual oils, e.g., atmospheric-gas oils (AGO), heavy vacuum gas oils (VGO)—that portion of the atmospheric distillate having a boiling point range between about 340° and 565° C.—and "short" or vacuum residuum—that portion of the distillate having a boiling point range in excess of 565° C.

Olefins may be produced in accordance with the invention by thermal cracking with steam an olefin feedstock of petroleum residuum. The petroleum residuum contains short residuum having a boiling point greater than 565° C. Up to 100 weight percent of the petroleum residuum is short residuum. Typically, the amount of short residuum in the petroleum residuum is between from about 5 to about 50 weight percent.

At least 3 weight percent of the short residuum contained within the olefin feedstock has a boiling point greater than or equal to 650° C. In a preferred embodiment, at least 6, most preferably about 20 to about 60, weight percent of the short residuum of the petroleum residuum has a boiling point greater than or equal to 650° C.

The petroleum residuum of the invention further has pentane insolubles, ASTM D-893, less than or equal to 1.2, preferably less than or equal to 1.0. In addition, the weight percent of hydrogen of the petroleum residuum comprising the olefin feedstock is greater than or equal to 12.5, preferably greater than or equal to 12.7, most preferably greater than 13.0 but less than 13.8.

The process of the invention is especially useful for the treatment of vacuum, or short residuum feedstocks, i.e., that portion of the atmospheric residuum having a boiling point greater than 565° C. Alternatively, the process of the invention may be directed to atmospheric, or long residuum feedstocks, defined as the combination of VGO and short residuum.

Where the petroleum residuum olefin feedstock has pentane insolubles in excess of 1.2, ASTM D-893, it must first be subjected to deasphalting. Feedstocks having pentane insolubles less than 1.2 need not be deasphalted. While it is not necessary to deasphalt residuum having less than 1.2 pentane insolubles, it may sometimes be desirable for commercial convenience to deasphalt if the pentane insolubles is between about 0.6 to about 1.2.

Removal of the asphaltene components from residual oil is necessary in order to prevent such components from being deposited onto the downstream hydrogenation catalyst or within the pyrolysis furnace. Deasphalted petroleum residua exhibit an improved olefins yield profile during thermal cracking.

Petroleum residuum having pentane insolubles greater than 1.2 may be deasphalted by solvent extraction processes known in the art. Preferred solvent extraction processes operate near or above the critical temperature of the solvent, or mixture of solvents, by conventional means in the art. For example, the petroleum residuum may be extracted using a single nonpolar solvent such as by conventional means in the art. Typically such extraction employs a $C_3$ to $C_7$ paraffin or isoparaffin hydrocarbon or a mixture thereof. Preferably, the extraction solvent is liquefied butane or i-butane or a mixture thereof.

The deasphalting stage is illustrated in FIG. 1. The deasphalting tower 1 is designed to provide countercurrent liquid-liquid contact of the petroleum residuum with liquefied hydrocarbon solvent. As exemplified, the liquefied hydrocarbon solvent is typically charged to the bottom portion of the deasphalting tower by way of a charge line 2 and the petroleum residuum 3 is charged to the tower at approximately the midway point. The asphalt fraction is discharged from deasphalting tower 1 by way of bottoms line 11 along with a solution of deasphalted oil in liquefied hydrocarbon solvent.

The deasphalting step is conducted until the pentane insolubles, ASTM D-893, of the petroleum residuum is less than or equal to 1.2. Typically, the yield of deasphalted oil (feed less the extractable heavy metals, asphaltenes, sulfur and nitrogen in the feedstock) increases with the number of carbon atoms in the hydrocarbon solvent employed, but the concentration of metals, asphaltenes, sulfur and nitrogen left in the deasphalted oil also rises with the number of carbon atoms in the solvent.

The solvent extraction is conducted at pressures sufficient to maintain the solvents in the liquid phase. Preferred extraction temperatures typically are in the range of 30° to 100° C., preferably 40° to about 65° C., and extraction pressure are typically in the range of about 20 to about 35 bar.

Where the extraction process is conducted in a countercurrent extraction tower, the pressure of the countercurrent extraction tower is under 30 bar, the temperature typically being 45° C. in the sump and typically 75° C. in the head of the column.

The solution of deasphalted oil in liquefied hydrocarbon solvent is typically then withdrawn from the top of the deasphalting tower 1 by way of a discharge line 6 and passed to a suitable stripping chamber 7 wherein the liquefied hydrocarbon solvent is flashed from the deasphalted oil, the volatilized hydrocarbon being discharged from the stripping chamber at 8. The deasphalted oil is discharged from the stripping zone by way of a bottoms line 9 containing a pump. It may then be fed into a heater 5 for heating of the deasphalted petroleum residuum into either a hydrotreatment chamber or pyrolysis chamber.

Further, the method and conditions recited in U.S. Pat. No. 4,239,616 and the prior art discussed therein, all of which is herein incorporated by reference, may be employed. The '616 patent discloses a process for treating residuum by contacting the residuum with a solvent in a mixing zone. The admixture is then introduced into a first separation zone, which is maintained at an elevated temperature and pressure. Separation of the mixture into a fluid-like first light phase comprising oils, resins and solvent and a fluid-like first heavy phase comprising asphaltenes and solvent results. The first light phase is then withdrawn from the first separation zone and introduced into a second separation zone.

A separation zone can be included in the process as an option and would be maintained at a temperature level higher than the temperature level in the first separation zone, which is maintained at an elevated pressure. This pressure can be the same pressure as that maintained in the first separation zone. The first light phase is therefore separated into a second light phase comprising oils and solvent (which collects in the upper portion of the second separation zone) and a second heavy phase comprising resins and solvent.

The first heavy phase is then withdrawn from the first separation zone and at least a portion is introduced into the upper portion of the second separation zone, where it contacts the second light phase and settles therethrough to remove at least a portion of any resinous bodies that may be entrained in the second light phase.

The second light phase is then withdrawn and introduced into a third separation zone which is maintained at an elevated temperature and pressure to effect a separation of the second light phase into a third light phase comprising solvent and a third heavy phase comprising oils. The third heavy phase is then withdrawn from the third separation zone and recovered.

It was discovered that addition of short residuum to the petroleum residuum prior to entry of the petroleum residuum into the deasphalting tower facilitated the deasphalting operation. In particular, addition of short residuum was found to render the long residuum easier to process. Particularly desirable results are obtained when between about 20 to about 50 weight percent of the blend is short residuum.

Residual feedstocks having a hydrogen content less than 12.5 weight percent, preferably less than 12.7 weight percent, are further subjected to hydrotreatment processing. Feedstocks having a hydrogen content greater than or equal to 12.5 weight percent, preferably greater than or equal to 12.7 weight percent, need not be subjected to hydrotreatment. It is possible therefore that the olefin feedstock for use in the process of the invention may not require either deasphalting or hydrotreatment. This is the case where the residual feedstock has pentane insolubles less than 1.2, ASTM D-893, and a hydrogen content greater than or equal to 12.5 weight percent.

As used herein the term "hydrotreatment" and "hydrotreating" shall refer to a process of treating a residuum feedstream with hydrogen for a period of time and at a temperature sufficient to render a product wherein less than or equal to 7 weight percent of the hydrocarbon product has a boiling point less than 200° C.

Hydrotreatment typically consists of three operations. In the first, metals—most notably vanadium and nickel—are removed from the feedstream. Metal removal can be carried out in separate or mixed catalyst beds. In the second operation of hydrotreatment, sulfur and/or nitrogen are removed or minimized from the feedstream. In the third operation of hydrotreatment, polynuclear aromatic compounds are saturated.

In a preferred embodiment of the invention, the metals removal and hydrodesulfurization/hydrodenitrification are carried out in separate beds in series with recycled hydrogen containing progressively higher concentrations of hydrogen sulfide and ammonia, and the aromatics saturation process is carried out in a second stage with hydrogen containing minimal hydrogen sulfide.

In general, hydrotreatment consists of first removing from the petroleum residuum metals and heterocyclic atoms, such as nitrogen and sulfur prior to the entry of the feedstream into the aromatic saturation section of the hydrotreater. The process next includes the saturation of polynuclear aromatics in the feedstream. During hydrotreatment in the aromatic saturation section, breaking of the carbon-carbon bonds of the aromatic compounds are not intended to be broken. It is not necessary to this process for monoaromatic compounds to be entirely saturated. It is more preferred to operate the hydrotreatment such that less than 5 wt % of the hydrotreated hydrocarbon product converted from the feedstock has a boiling point range less than 200° C.

In a preferred embodiment of the invention, metals removal and hydrodesulfurization/hydrodenitrification are carried out in separate beds; and the saturation process is carried out in a third stage with hydrogen containing minimal hydrogen sulfide in counter current or concurrent flow.

It is highly desirable to minimize the amount of cracking that occurs in the feedstock during hydrotreatment. While a limited amount of hydrodealkylation may be both unavoidable and tolerated, severe cracking of the product requires unnecessarily greater quantities of hydrogen and forms products which may have a poorer overall olefins yield profile. The third step of hydrotreatment should serve to saturate the polynuclear aromatics.

Catalyst compositions for hydrotreating are well known to those skilled in the art and are commercially available. Metal oxide catalysts that fall into this area are cobalt-molybdenum, nickel-tungsten, and nickel-molybdenum supported catalysts. The support is usually alumina.

The same catalysts may also be used for demetallization, desulfurization/denitrification and saturation. Any catalyst which is capable of removing most metals and substantially all sulfur and nitrogen content from the feed may be used for the demetallization and desulfurization/denitrification. In addition, the catalyst selected should be capable of catalyzing the hydrogenation of compounds containing aromatic rings without substantial structural alteration or breakdown.

Suitable catalysts include cobalt/molybdenum/alumina, nickel/cobalt/molybdenum/alumina, cobalt/molybdenum/alumina, nickel/molybdenum/alumina, and cobalt/tungsten/alumina. The catalyst may also be used in the sulfided form.

Such catalysts are conventionally prepared by impregnating a catalyst support with an aqueous solution of a salt of the metal, either consecutively or simultaneously. Thus, nickel may be added in the form of nickel nitrate, tungsten as ammonium metatungstate, cobalt as cobalt nitrate, acetate, etc. and molybdenum as ammonium molybdate. It will usually be found convenient to impregnate the support first with the salt of the metal that is to be present in the highest concentration in the finished catalyst, though this is not essential. Other methods of preparing the catalyst include precipitating the metals on the support from a solution of their salts and coprecipitation of the metals with the hydrated support material.

For maximum effectiveness, the metal oxide catalysts should be converted at least in part to metal sulfides. The metal oxide catalysts can be sulfided in the hydrotreatment unit by contact at elevated temperatures with hydrogen sulfide or a sulfur-containing oil. Alternatively, a commercially available metal oxide catalyst having sulfur incorporated therein may be employed. These presulfurized catalysts may be loaded into the hydrotreatment unit and brought up to reaction conditions in the presence of hydrogen causing the sulfur to react with the hydrogen. The metal oxides are thereby converted to sulfides.

It is preferred that the catalysts be activated before use in the reaction by contact with a stream of hydrogen containing hydrogen sulfide at a temperature in the range of 100° to 800° C., preferably 300° to about 450° C., for a period of 1 minute to 24 hours sulfided form of the catalyst may be prepared by passing hydrogen through liquid tetrahydrothiophene and then over the catalyst maintained at a temperature in the range of about 100° C. to about 800° C., preferably about 300° C. to about 450° C., for a period of 1 minute to 24 hours.

In a most preferred embodiment, the catalysts systems include cobalt/molybdenum/alumina, nickel/molybdenum/alumina, or nickel/tungsten/alumina. These catalysts are normally purchased in the metal oxide state and must be activated before use in the reaction by contact with a stream of hydrogen containing hydrogen sulfide or other suitable presulfiding agent such as dimethyl disulfide or carbon disulfide at a temperature of 210 to 800° C., preferably 250 to 450° C. until sulfur uptake is completed. It is preferred that a catalyst system including nickel/alumina only be used in the reduced state as saturation catalyst and should not be presulfided.

Hydrotreatment is conducted at high temperatures and high pressures. Typically, the temperature in the hydrogenation chamber is in the range of about 340° C. to about 450° C., preferably about 360° to about 400° C., and the pressure is the range of about 1,200 to about 5,000 psig, preferably 1,800 to 3,500 psig, most preferably 2,000 to about 3,000 psig, and most preferred about 2,200 to about 3,000 psig. The hydrocarbon Weight Hourly Space Velocity (WHSV) may be in the range of 0.1 to 5.0, preferably 0.1 to 2.0. Hydrogen supply may be in the range of 100 $m^3$/tonne to 2,000 $m^3$/tonne of the hydrocarbon feedstock, preferably in the range of 200 $m^3$ per tonne to 1,000 $m^3$ per tonne of hydrocarbon feedstock.

In a most preferred embodiment of the invention, the petroleum residuum is treated with hydrogen for a sufficient time in order to render a product wherein less than or equal to 5 weight percent of the hydrocarbon product has a boiling point less than 200° C.

Hydrogen may be passed through scrubbers to remove hydrogen sulfide and ammonia before recycle. However, other methods of operation may also be used such as batch operation in an autoclave.

Hydrogenation is typically carried out in a series of two or more operations using the same or different catalysts though single stage hydrogenation may be acceptable. Hydrogen flow can be in the co-current or countercurrent direction.

Figure 2:
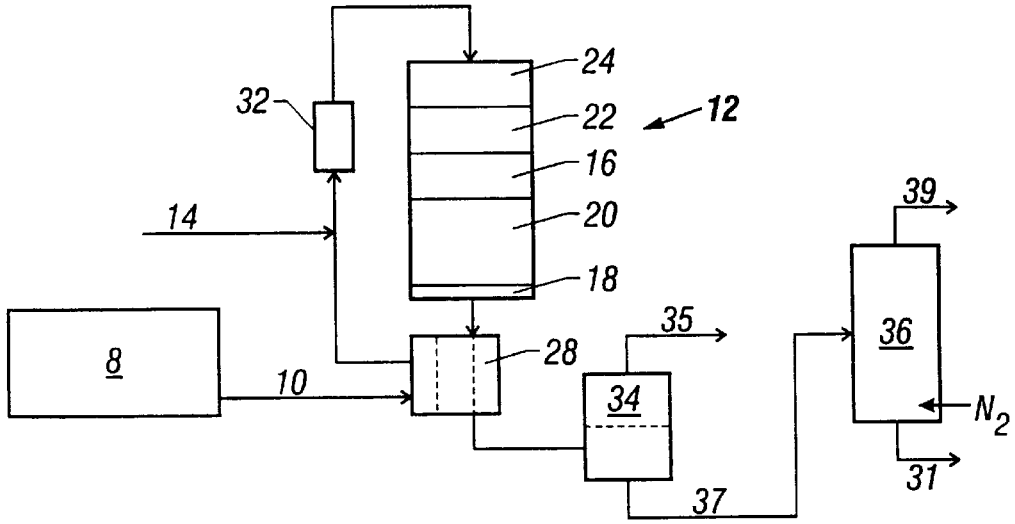
FIG. 2 is a schematic flow diagram of a pilot plant hydrotreatment unit used in the process of the invention.
Figure 3:
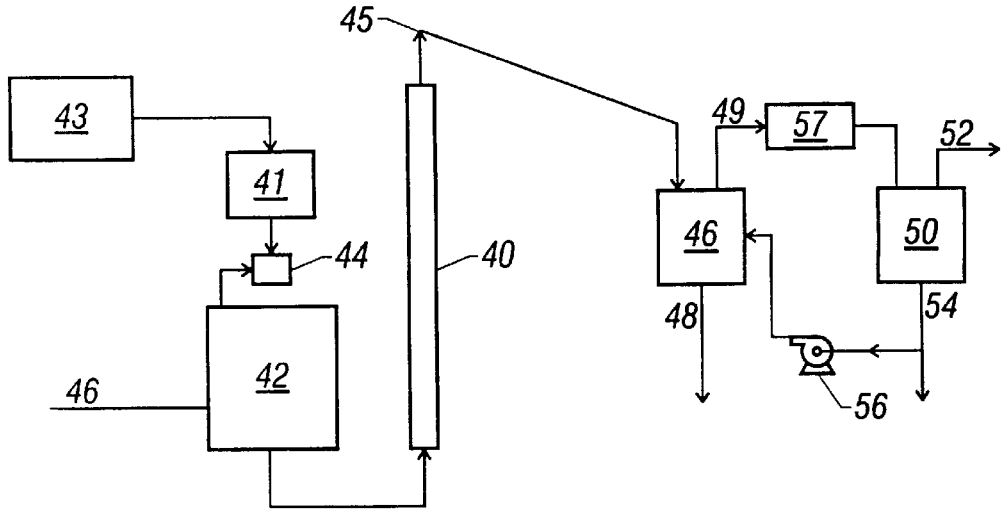
FIG. 3 is a schematic flow diagram of a pilot plant thermal steam cracking apparatus used in the process of the invention.

FIGS. 2 and 3 are offered only for purposes of illustration of operation of the invention and refer to the pilot plant operation hydrotreatment and thermal steam cracking (pyrolysis) chamber, respectively.

Referring now to FIG. 2, a petroleum residuum having pentane insolubles less than or equal to 1.2 in accordance with the invention was hydrogenated by passing the petroleum residuum 10 over a fixed catalyst bed 12 with gaseous hydrogen 14 in a downward flow. The hydrogenation chamber 16 was composed of 316 stainless steel pipe. As delineated in FIG. 2, hydrogenation chamber 16 has a length of 194 cm and an inside diameter of 8 cm. Hydrogenation chamber 16 is capable of withstanding pressures of up to 3,350 psig and temperatures of up to 454° C.

The chamber was loaded first with alumina support balls 18. On top of these support balls is loaded (at 20) 3.9 kg of Criterion 424 hydrotreating catalyst, a product of Criterion Catalysts. Criterion 424 contains 3 weight percent nickel and 13 weight percent molybdenum on an extrudate of alumina with a trilobe shape and a diameter of 1.3 mm. On top of this catalyst is loaded (at 16) 0.8 kg of Criterion RN-410 desulfurization/denitrification catalyst containing 1.9 weight percent nickel and 8.0 weight percent molybdenum on alumina extrudate of the dimensions and size recited above. On top of this was loaded (at 22) 1.2 kg of Criterion RM-430 demetallization catalyst containing 4.0 weight percent molybdenum, again on an alumina extrudate in a trilobe shape with a diameter of 1.3 mm. Alumina support balls were then loaded (at 24) on top of the RM-430 catalyst.

Criterion 424 catalyst is sensitive to metals, sulfur and nitrogen in the feedstock. Therefore, demetallization catalyst RM-430 and desulfurization/denitrification catalyst RN-410 are preferably loaded upstream of the hydrogenation catalyst to insure the maximum amount of conversion of the hydrogen deficient moieties. The hydrocarbon feed contacts the RM-430 catalyst first as it moves downward through the reactor. The RM-430 catalyst primarily removes metals.

The pore volume of the catalyst decreases as one passes from the top bed to the lower bed, the pore volume of the top bed being 0.92 cc/g, the pore volume of the middle bed being 0.67 cc/g, and the pore volume of the lower bed being 0.47 cc/g. All three catalysts have comparable surface areas of between 145 and 155 $m^2$/g.

The feed then contacts the RN-410 catalyst which removes additional metals, sulfur and nitrogen from heteroatomic molecules containing them. The RN-410 catalyst acts as the final guard bed to prevent high concentrations of metals from contacting the 424 catalyst.

The feedstream is pumped through heat exchanger 28 where it is warmed by the product from hydrotreatment chamber 16. The hydrocarbon is then mixed with gaseous hydrogen at 14. Hydrogen is added at the rate of between about 300 to about 500 $m^3$/tonne. The two-phase mixture passes through electric heater 32 where the temperature of the mixture is raised to about 280 to about 400° C. The mixture is then introduced into hydrotreatment chamber 12 and allowed to flow in a downward direction through the catalyst bed. As the hydrogenated product leaves the reactor, it passes through heat exchanger 28 where it is cooled by the transference of energy to the incoming feed stream.

The cooled product then enters high-pressure separator flash drum 34 where the gaseous components 35 are separated from the hydrogenated oil stream 37. The liquid effluent from the high-pressure separator flash drum 34 is then introduced into the middle zone of nitrogen stripping column 36. The column is maintained at about 38° to about 120° C. and between 0 to about 15 psig. Nitrogen is introduced into the bottom of nitrogen stripping column 36 and serves to remove the lighter components 39 in the hydrogenated product. These components include hydrogen sulfide gas, ammonia and small amounts of $C_1$ through $C_5$ hydrocarbons. The stripped liquid product 31 is collected for use as pyrolysis feedstock.

Typically about 80 to about 95, at a minimum 65, weight percent of the petroleum residuum is introduced into the thermal cracking pilot unit illustrated in FIG. 3.

As illustrated in FIG. 3, a feedstock having pentane insolubles, ASTM D-893, less than or equal to 1.2 and hydrogen content greater than or equal to 12.5 may be converted into desirable olefin products. Thermal cracking tube 40 may be made of Incoloy (800HT) such as that having an inside diameter of 1.58 cm and a length of 810 cm. A 762 cm section of the pipe is heated by electric furnace to about 700° to about 850° C. The furnace may have a multitude of independently controlled heating zones.

Before entering thermal cracking tube 40, the olefin feedstock enters heater 41 from olefin feedstock entry port 43. The feedstock is heated in heater 41 to a temperature of from 260° to about 430° C. The hydrocarbon is mixed with steam in mixing chamber 44 at a temperature of about 480° to about 760° C. in a ratio of 0.6 to about 2.0 kg steam per kg of hydrocarbon. Proper mixing of the steam and hydrocarbon is often critical to the successful operation of the cracking tube.

The hydrocarbon is then injected at the top center of mixing chamber 44 while the steam enters the chamber from side 46, both radially and tangentially to promote thorough mixing of the two streams. The steam/oil mixture is further preferably heated (electrically) to a temperature sufficient to fully vaporize the hydrocarbon in heater 42 before entering thermal cracking tube 40. The flow rates of the oil and steam streams may be chosen to give a 0.2 to about 0.5 second residence time of the vaporized components in cracking tube 40, at a cracking tube temperature of about 700 to about 850° C. In cracking tube 40, the feedstock is converted to the desirable light olefin products, as well as by-product liquids.

After exiting cracking tube 40, the steam/hydrocarbon mixture is diluted with quench water (at 45) in order to rapidly lower the temperature (down to about 300° to about 500° C.) of the effluent stream to reduce secondary condensation reactions. The diluted product is directed into a separator vessel 46 where the majority of the fuel oil is withdrawn as liquid phase 48. The remaining vapor stream 49 is further cooled and additional liquids, including water, are separated in second separation vessel 50 after passing through heat exchanger 57. The lighter compounds that do not condense are removed as vapor stream at 52 and the heavier compounds are collected as a liquid product at 54. Pump 56 allows optional recirculation of liquid effluent 54 back to first separatory vessel 46 to act as a reflux stream to increase separation of liquid hydrocarbons.

EXAMPLE 1

A sample of atmospheric residuum was obtained from Howell Refining Incorporated. This material is labeled as "Feed A". It was not necessary to solvent deasphalt or hydrotreat this petroleum residuum. It was found to have the following properties shown in Table 1:

TABLE 1

| | FEED A |
|---|---|
| API Gravity, ASTM D4052 | 26.0 |
| Sulfur, ASTM D2622 | 0.13 wt % |
| Conradson Carbon, ASTM D4530 | 0.6 wt % |
| Hydrogen Content, ASTM D4880 | 12.8 wt % |
| Pentane Insolubles, ASTM D893 | 0.5 wt % |
| BOILING POINT DISTRIBUTION, ASTM D2887 | |
| Initial Boiling Point (IBP) to 200° C. | 0 wt % |
| 200–340° C. | 9.6 wt % |
| 340–540° C. | 81.5 wt % |
| 540–565° C. | 3.0 wt % |
| 565–590° C. | 2.2 wt % |
| 590–625° C. | 2.0 wt % |
| 625–650° C. | 1.3 wt % |
| 650+° C. | 0.4 wt % |

Figure 4:
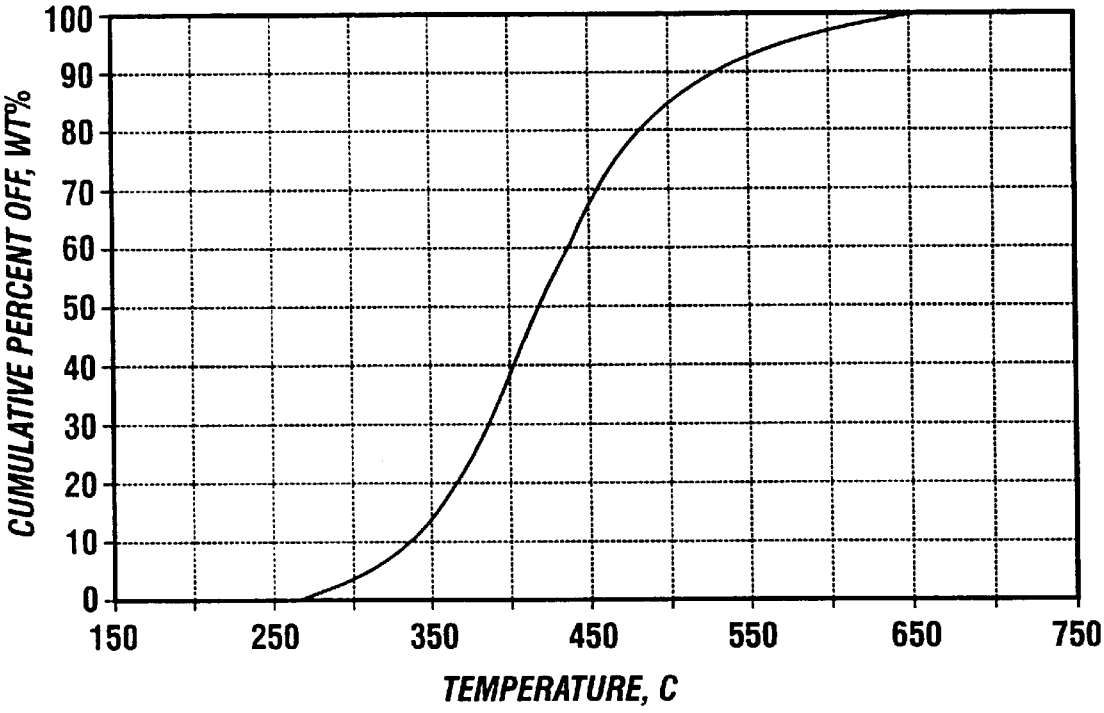
FIG. 4 is a boiling point distillation curve of a petroleum residuum obtained from Howell Refining Incorporated, Example 1.

The boiling point distribution curve of Feed A is set forth in FIG. 4. As set forth in Table 1, about 6.8 percent of the short residuum has a boiling point in excess of 650° C. Feed A was subjected to thermal steam cracking in the thermal steam cracking apparatus as depicted in FIG. 3 and described previously. Feed A was metered at 3.3 kg/hr. It was blended with 4.0 kg/hr steam (1.2 kg steam per kg feed) and the mixture was further heated to 593° C. The mixture was fed to the thermal cracking tube 40 that was maintained at 760° C. external tube metal temperature. The steam and oil flow rates were calculated to result in a 0.35 second residence time. The vapor stream was analyzed to determine the distribution of thermal steam cracking products shown in Table 2.

TABLE 2

| | |
|---|---|
| Hydrogen | 0.5 wt % |
| Methane | 7.3 wt % |
| Ethylene | 18.6 wt % |
| Acetylene | 0.1 wt % |
| Ethane | 3.1 wt % |
| Propylene | 13.0 wt % |
| Propane | 0.5 wt % |
| Higher Molecular Weight Compounds | 57.9 wt % |

EXAMPLE 2

A West African crude oil from Angola was fractionated to provide a petroleum residuum, referred to herein as "Feed B", with the composition set forth in Table 3.

TABLE 3

| | FEED B |
|---|---|
| API Gravity, ASTM D4052 | 20.7 |
| Sulfur, ASTM D2622 | 0.2 wt % |
| Conradson Carbon, ASTM D4530 | 7.2 wt % |
| Hydrogen Content, ASTM D4808 | 12.1 wt % |
| Pentane Insolubles, ASTM D893 | 3.6 wt % |
| Nitrogen, ASTM D4629 | 0.2 wt % |
| Nickel, Atomic Absorption | 31 ppm |
| Vanadium, Atomic Absorption | 4 ppm |
| Distillation Curve, ASTM D1160 | |
| Volume % Off | Temperature |
| IBP | 311° C. |
| 5% | 381° C. |
| 10% | 389° C. |
| 20% | 408° C. |
| 30% | 432° C. |
| 40% | 456° C. |
| 50% | 482° C. |
| 60% | 524° C. |
| 70% | 578° C. |
| 78% | 599° C. |
| 78%–100% | Residue |

Feed B was then deasphalted by solvent extraction with isobutane at a treat rate of eight kg of solvent per kg of feed. Approximately 90 wt % of Feed B was recovered as Deasphalted Oil (DAO) and 10 wt % of resins and asphaltenes were removed. The resulting product is termed "Feed C". The following analyses, listed in Table 4, describe the quality of the resulting DAO in Feed C and Table 5 depicts the weight range distribution by boiling point:

TABLE 4

| | FEED C |
|---|---|
| API Gravity, ASTM D4052 | 23.8 |
| Sulfur, ASTM D2622 | 0.2 wt % |
| Conradson Carbon, ASTM D4530 | 2.6 wt % |
| Hydrogen Content, ASTM D4880 | 12.6 wt % |
| Pentane Insolubles, ASTM D893 | 0.2 wt % |
| Nitrogen, ASTM D4629 | 0.2 wt % |
| Nickel, Atomic Absorption | 4 ppm |
| Vanadium, Atomic Absorption | 0.6 ppm |

TABLE 5

| Boiling Range Curve, ASTM D2887 | |
|---|---|
| IBP–200° | 0 |
| 200–340° C. | 1.3 wt % |
| 340–540° C. | 65.3 wt % |
| 540–565° C. | 6.7 wt % |
| 565–590° C. | 6.6 wt % |
| 590–625° C. | 5.7 wt % |
| 625–650° C. | 4.4 wt % |
| 650+° C. | 11.3 wt % |

Figure 5:
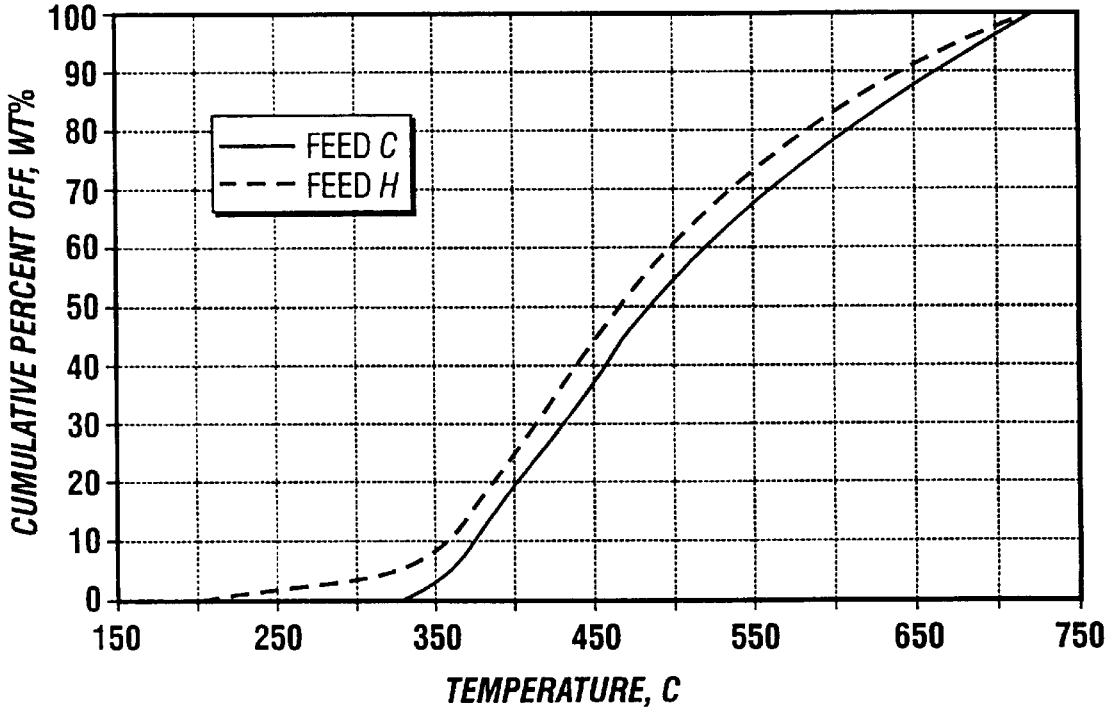
FIG. 5 is a boiling point distillation curve of a deasphalted oil obtained from a West African petroleum crude oil long residuum from Angola, Example 2 and Example 5.

The boiling point distribution is graphically depicted in FIG. 5. As illustrated in Table 5, about 40.4 percent of the short residuum has a boiling point in excess of 650° C. Feed C was then thermally steam cracked in the thermal steam cracking apparatus as depicted in FIG. 3 and described previously. Feed C was metered at 3.5 kg/hr. It was then blended with 4.2 kg/hr steam (1.2 kg steam per kg feed) and the mixture was further heated to 593° C. The mixture was then fed to the cracking coil that was maintained at 760° C. external tube temperature. The steam and oil flow rates were calculated to result in a 0.35 second residence time of the vapors in the cracking coil. The product streams were analyzed to determine the distribution of products shown in Table 6.

TABLE 6

| Component | Wt. % |
|---|---|
| Hydrogen | 0.5 |
| Methane | 7.3 |
| Ethylene | 18.7 |
| Acetylene | 0.2 |
| Ethane | 2.7 |
| Propylene | 12.6 |
| Propane | 0.4 |
| Higher Molecular Weight Compounds | 57.6 |

EXAMPLE 3

A West African Crude Oil from Nigeria was fractionated to produce petroleum residuum, Feed D. Feed D was processed in the hydrotreatment apparatus set forth in FIG. 2 and as described above (without first deasphalting). Feed D was fed to the reactor at a rate of 5.9 kg per hour, which was equivalent to a 1.0 Weight Hourly Space Velocity (WHSV). Hydrogen was fed to the unit at a rate of 2.3 $m^3$/hr, equivalent to 394 $m^3$/tonne The reactors external wall temperature was maintained at 382° C. throughout the run. The pressure of the reactor was controlled at 2,700 psig. The product from this unit was collected and then passed through the hydrotreatment chamber a second time at the same flow rate as the first pass, but with a reactor skin temperature of 389° C. The resulting product is termed "Feed E." The overall space velocity for this two pass operation is equivalent to 0.5 WHSV. Analyses of the feed (Feed D) and hydrogenated liquid product (Feed E) are given below in Table 7:

TABLE 7

| | Feed D | Feed E |
|---|---|---|
| API Gravity, ASTM D4052 | 21.7 | 25.9 |
| Sulfur, ASTM D2622 | 0.21 wt % | 0.01 wt % |
| Conradson Carbon (D4530) | 3.4 wt % | 0.7 wt % |
| Hydrogen Content, ASTM D4808 | 12.2 wt % | 12.9 wt % |
| Pentane Insolubles, ASTM D893 | 0.5 wt % | 0.1 wt % |
| Boiling Point Distribution | | |
| IBP-200° C. | 0 wt % | 1.2 wt % |
| 200–340° C. | 7.8 wt % | 13.2 wt % |
| 340–540° C. | 78.3 wt % | 74.0 wt % |
| 540–565° C. | 2.3 wt % | 2.9 wt % |
| 565–590° C. | 3.7 wt % | 2.4 wt % |
| 590–625° C. | 2.9 wt % | 2.4 wt % |
| 625–650° C. | 1.8 wt % | 1.2 wt % |
| 650+° C. | 3.2 wt % | 2.7 wt % |

Figure 6:
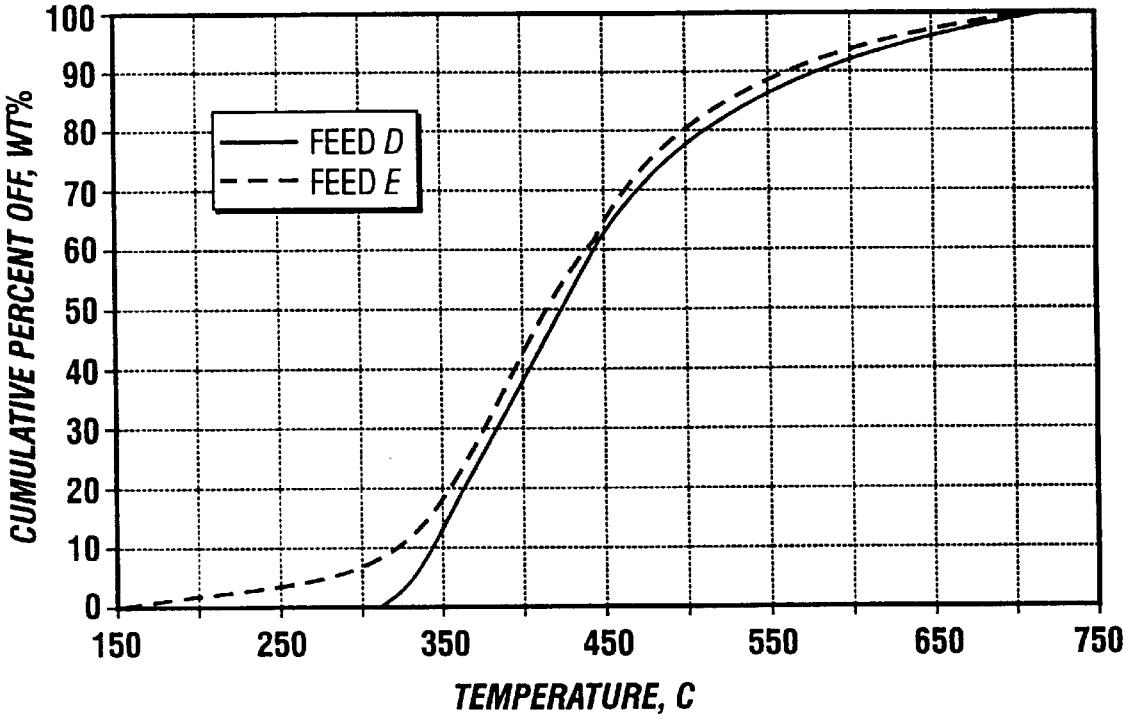
FIG. 6 is a boiling point distillation curve of a West African crude oil long residuum from Nigeria, Example 3.

As set forth in Table 7, about 27.6 and 31.0 percent of the short residuum of Feed D and Feed E, respectively, has a boiling point in excess of 650° C. The boiling point distributions are graphically depicted in FIG 6.

The liquid product from the hydrotreatment chamber was used as a feed to the thermal steam cracking apparatus. The operation was carried out in the pilot plant equipment depicted in FIG. 3 and described previously. The olefin feedstock was metered at 3.4 kg/hr. The olefin feedstock was blended with 4.0 kg/hr steam (1.2 kg steam per kg feed) and the mixture was further heated to 573° C. The mixture was fed to the thermal cracking tube 40 that was maintained at 760° C. external tube temperature. The steam and oil flow rates were calculated to result in a 0.35 second residence time of the vapors in the cracking tube. The vapor stream was analyzed to determine the distribution of products shown in Table 8.

TABLE 8

| | |
|---|---|
| Hydrogen | 0.6 wt % |
| Methane | 8.0 wt % |
| Ethylene | 16.5 wt % |
| Acetylene | 0.1 wt % |
| Ethane | 2.9 wt % |
| Propylene | 11.8 wt % |
| Propane | 0.5 wt % |
| Higher Molecular Weight Compounds | 59.6 wt % |

EXAMPLE 4

A sample of deasphalted oil (DAO) product from atmospheric residuum was obtained from a commercial source. This DAO product will be referred to as "Feed F". The characteristics of Feed F is depicted in Table 9.

Feed F was processed in the hydrogenation chamber 16 as shown in FIG. 2 and as described above at a rate of 2.9 kg per hour, which is equivalent to a 0.5 WHSV. Hydrogen was fed to the unit at a rate of 1.4 $m^3$/hr, equivalent to 480 $m^3$/tonne. The outside wall of the hydrotreating reactor was maintained at a temperature of 392° C. throughout the run. The pressure of the reactor was controlled at 2,800 psig. Analyses of the liquid feed (Feed F) and product (Feed G) are shown in Table 9.

TABLE 9

| | Feed F | Feed G |
|---|---|---|
| API Gravity (D4052) | 20.8 | 25.2 |
| Sulfur (D2622) | 0.85 wt % | 0.03 wt % |
| Conradson Carbon (D4530) | 5.5 wt % | 1.2 wt % |
| Hydrogen Content (D4808) | 12.2 wt % | 13.0 wt % |
| Pentane Insolubles (D893) | 0.9 wt % | 0.5 wt % |
| Boiling Point Distribution | | |
| IBP–200° C. | 0 wt % | 0.3 wt % |
| 200–340° C. | 7.5 wt % | 9.4 wt % |
| 340–540° C. | 44.2 wt % | 47.6 wt % |
| 540–565° C. | 8.7 wt % | 8.8 wt % |
| 565–590° C. | 8.4 wt % | 8.5 wt % |
| 590–625° C. | 9.8 wt % | 9.5 wt % |
| 625–650° C. | 6.0 wt % | 5.3 wt % |
| 650+° C. | 15.4 wt % | 10.6 wt % |

Figure 7:
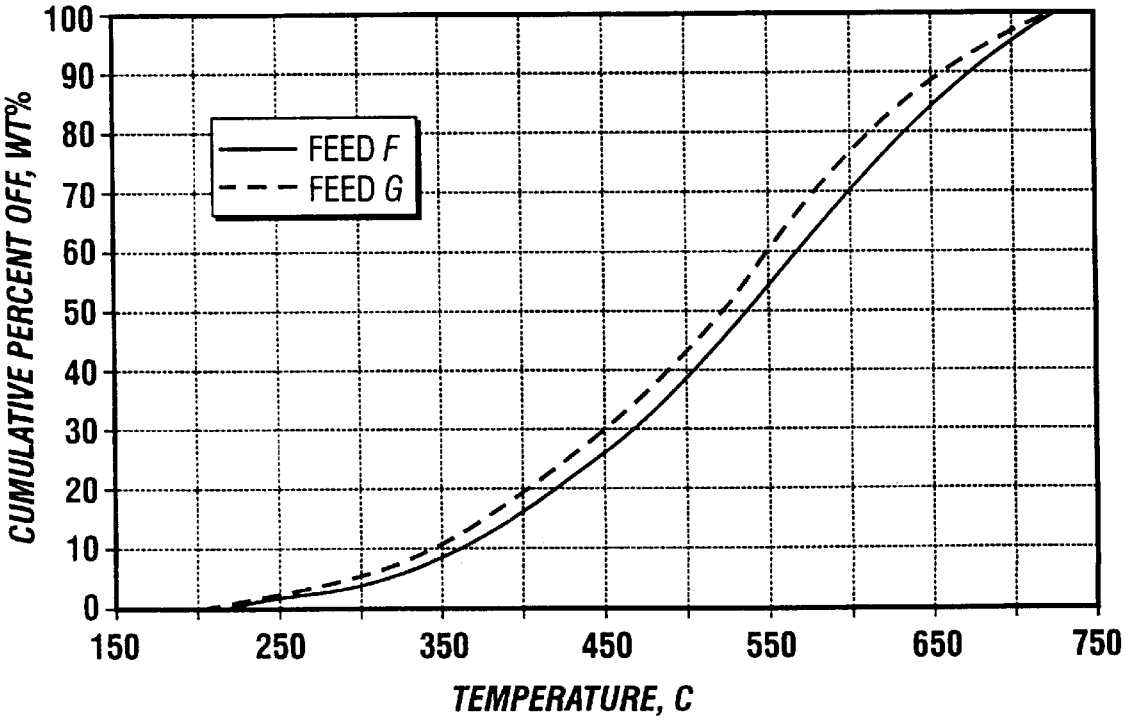
FIG. 7 is a boiling point distillation curve of a commercially available deasphalted oil from atmospheric residuum, Example 4.

As set forth in Table 9, about 38.9 and 31.3 percent of the short residuum of Feed F and Feed G, respectively, have a boiling point in excess of 650° C. The distillation curves are set forth in FIG. 7.

The liquid product from the hydrogenation chamber is used as feed to a pyrolysis furnace. The operation is carried out in the pyrolysis apparatus depicted in FIG. 3 and as described previously. The olefin feedstream was metered at 3.5 kg/hr. The hydrocarbon was blended with 4.3 kg/hr steam (1.2 kg steam per kg feed) and the mixture was further heated to 593° C. The mixture was fed to the thermal cracking tube that was maintained at 760° C. The steam and oil flow rates were calculated to result in a 0.35 second residence time of the vapors in the cracking coil. The vapor stream was analyzed to determine the distribution of products set forth in Table 10.

TABLE 10

| | |
|---|---|
| Hydrogen | 0.5 wt % |
| Methane | 7.4 wt % |
| Ethylene | 19.2 wt % |
| Acetylene | 0.2 wt % |
| Ethane | 2.8 wt % |
| Propylene | 13.2 wt % |
| Propane | 0.4 wt % |
| Higher Molecular Weight Compounds | 56.3 wt % |

EXAMPLE 5

The deasphalted oil product of Example 2 (Feed C) is used as feedstream to the hydrogenation chamber depicted in FIG. 2. Feed C was fed to the reactor at a rate of 2.9 kg per hour, which was equivalent to a 0.5 Weight Hourly Space Velocity (WHSV). Hydrogen was fed to the unit at a rate of 1.4 $m^3$/hr, equivalent to 490 $m^3$/tonne. A reactor outside wall temperature of 395° C. was maintained throughout the run. The pressure of the reactor was controlled at 2,800 psig. Analyses of the hydrotreater liquid feed (Feed C) and product (Feed H) are given in Table 11 and depicted in FIG. 5.

TABLE 11

| | Feed C | Feed H |
|---|---|---|
| API Gravity, ASTM D4052 | 23.8 | 26.9 |
| Sulfur, ASTM D2622 | 0.2 wt % | <0.01 wt % |
| Conradson Carbon, ASTM D4530 | 2.6 wt % | 0.5 wt % |
| Hydrogen Content, ASTM D4808 | 12.6 wt % | 13.2 wt % |
| Pentane Insolubles, ASTM D893 | 0.4 wt % | 0.7 wt % |
| Heptane Insolubles, ASTM IP143 | <0.05 wt % | <0.05 wt % |
| Nitrogen, ASTM D4629 | 0.2 wt % | <0.1 wt % |
| Nickel, Atomic Absorption | 4.0 ppm | 0.2 ppm |
| Vanadium, Atomic Absorption | 0.6 ppm | 0.1 ppm |
| Boiling Point Distribution | | |
| IBP–200° C. | 0 wt % | 0.2 wt % |
| 200–340° C. | 1.3 wt % | 5.8 wt % |
| 340–540° C. | 65.3 wt % | 66.5 wt % |
| 540–565° C. | 6.7 wt % | 5.4 wt % |
| 565–590° C. | 6.6 wt % | 5.0 wt % |
| 590–625° C. | 5.7 wt % | 5.8 wt % |
| 625–650° C. | 4.4 wt % | 3.6 wt % |
| 650+° C. | 11.3 wt % | 7.7 wt % |

About 40.4 and 34.9 percent of the short residuum contained within Feed C and Feed H, respectively, has a boiling point in excess of 650° C. Gaseous products were generated during the hydrotreatment process. Approximately 99.5 wt % of feed was recovered as liquid products. The remaining 0.5 wt % was converted to gaseous by-products, some of which was hydrogen sulfide and ammonia produced by the removal of heteroatoms from the feedstock. The distribution of products is presented in Table 12.

TABLE 12

| | |
|---|---|
| Hydrogen Sulfide | 0.1 wt % |
| Ammonia | 0.1 wt % |
| Light Hydrocarbons ($C_1$–$C_5$+) | 0.3 wt % |
| Liquid Products (Product J) | 99.5 wt % |

Hydrogen consumption for this olefin feedstream is calculated to be approximately 108 $m^3$/tonne. Feed H was used as feed to a thermal cracking apparatus. The operation was carried out in the pilot plant equipment as depicted in FIG. 3 and as described previously. The olefin feedstream was metered at 3.5 kg/hr. The hydrocarbon was blended with 4.3 kg/hr steam (1.2 kg steam per kg feed) and the mixture was further heated to 538° C. The mixture was fed to the thermal cracking tube that was maintained at 760° C. external tube temperature. The steam and oil flow rates were calculated to result in a 0.35 second residence time of the vapors in the cracking coil. The vapor stream was analyzed to determine the distribution of products as set forth in Table 13.

TABLE 13

| | |
|---|---|
| Hydrogen | 0.6 wt % |
| Methane | 8.7 wt % |
| Ethylene | 21.5 wt % |
| Acetylene | 0.3 wt % |
| Ethane | 2.7 wt % |
| Propylene | 12.7 wt % |
| Propane | 0.4 wt % |
| Higher Molecular Weights Compounds | 53.1 wt % |

EXAMPLE 6

In this example, a heavy Venezuelan crude oil is fractionated to produce petroleum residuum, i.e. Feed I, with the properties set forth in Table 14.

TABLE 14

| | FEED I |
|---|---|
| API Gravity, ASTM D4052 | 10.3 |
| Sulfur, ASTM D2622 | 2.8 wt % |
| Conradson Carbon, ASTM D4530 | 13.8 wt % |
| Hydrogen Content, ASTM D4880 | 10.5 wt % |
| Pentane Insolubles, ASTM D893 | 10.6 wt % |
| Heptane Insolubles, ASTM IP143 | 6.6 wt % |
| Nitrogen, ASTM D4629 | 0.3 wt % |
| Nickel, Atomic Absorption | 65 ppm |
| Vanadium, Atomic Absorption | 496 ppm |

Feed I was then deasphalted with n-butane as the deasphalting solvent at a ratio of eight kg of solvent per kg of feedstock. Approximately 80 wt % of the feedstock was recovered as Deasphalted Oil (DAO) and 20 wt % of the feed was removed as resins and asphaltenes. The resulting feedstream, Feed J was then hydrogenated in the hydrogenation chamber depicted in FIG. 2 and described previously. Feed J was fed to the reactor at a rate of 2.9 kg. per hour, which was equivalent to a 0.5 Weight Hourly Space Velocity (WHSV). Hydrogen was fed to the unit at a rate of 1.4 $m^3$/hr, equivalent to 462 $m^3$/tonne. A reactor outside wall of 382° C. was maintained throughout the run. The pressure of the reactor (Feed K) was controlled at 2,800 psig. The hydrotreated product (Feed K) was analyzed. The characteristics of Feed J and K are tabulated in Table 15.

TABLE 15

| | Feed J | Feed K |
|---|---|---|
| API gravity, ASTM D4052 | 15.0 | 23.5 |
| Sulfur, ASTM D2622 | 2.48 wt % | 0.05 wt % |
| Conradson Carbon, ASTM D4530 | 5.7 wt % | 0.7 wt % |
| Hydrogen Content, ASTM 4808 | 11.3 wt % | 12.8 wt % |
| Pentane Insolubles, ASTM D893 | 0.2 wt % | <0.05 wt % |
| BOILING POINT DISTRIBUTIONS | | |
| IBP–200° C. | 0 wt % | 1.3 wt % |
| 200–340° C. | 5.9 wt % | 14.9 wt % |
| 340–540° C. | 56.4 wt % | 58.2 wt % |
| 540–565° C. | 11.8 wt % | 6.1 wt % |
| 565–590° C. | 5.6 wt % | 3.7 wt % |
| 590–625° C. | 6.1 wt % | 5.3 wt % |
| 625–650° C. | 5.0 wt % | 3.3 wt % |
| 650+° C. | 14.1 wt % | 7.2 wt % |

Figure 8:
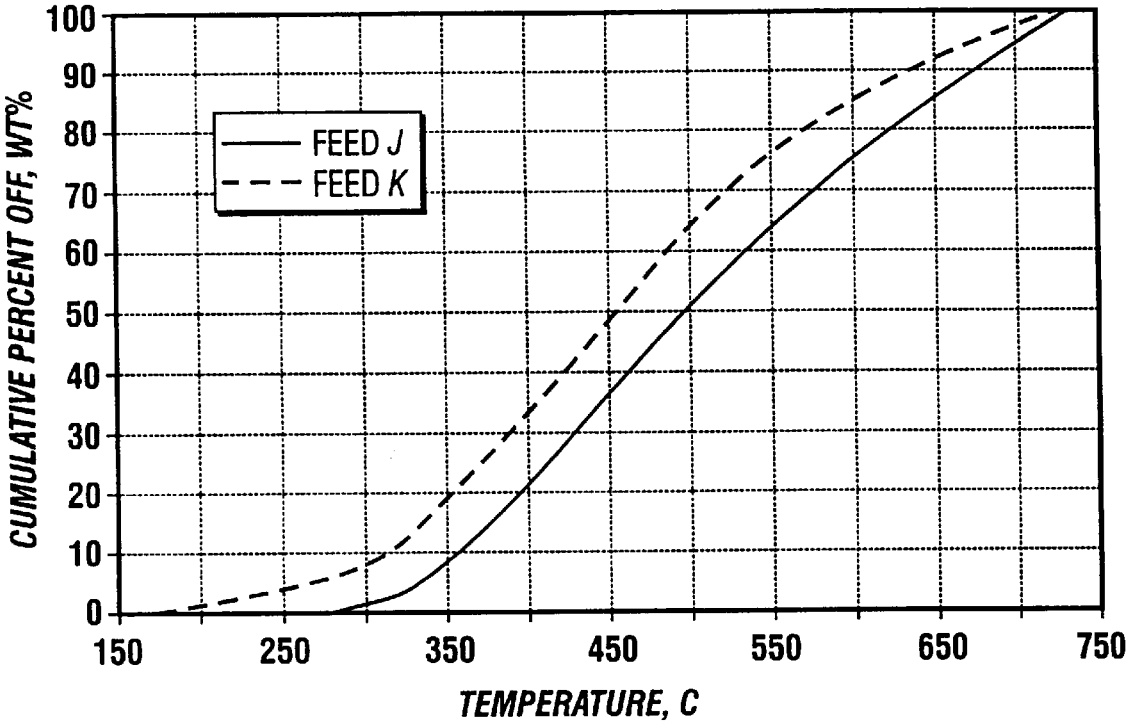
FIG. 8 is a boiling point distillation of a deasphalted oil obtained from a Venezuelan crude long residuum, Example 6.

About 45.8 and 36.9 percent of the short residuum contained within Feed J and Feed K, respectively, has a boiling point in excess of 650° C. The boiling point distributions are graphically depicted in FIG. 8. Approximately 94.6 wt % of feed was recovered as liquid products. The remaining 5.4 wt % was converted to gaseous by-products, much of which was hydrogen sulfide and ammonia produced by the removal of heteroatoms from the feedstock. The distribution of products is presented in Table 16.

TABLE 16

| | |
|---|---|
| Hydrogen Sulfide | 2.6 wt % |
| Ammonia | 0.2 wt % |
| Light Hydrocarbons | 2.6 wt % |
| Liquid Products | 94.6 wt % |

Hydrogen consumption was calculated to be approximately 166 $m^3$/tonne.

The liquid product from the hydrogenation chamber was then used as feed to a thermal steam cracking apparatus as depicted in FIG. 3 and as described previously. Feed K was fed to the thermal cracking tube at a rate of 3.5 kg/hr. Feed K was blended with 4.2 kg/hr steam (1.2 kg steam per kg feed) and the mixture was further heated to 593° C. The mixture was fed to the thermal cracking tube that was maintained at 760° C. outside tube temperature. The steam and oil flow rates were calculated to result in a 0.35 second residence time of the vapors in the cracking coil. The vapor stream was analyzed to determine the distribution of products as set forth in Table 17.

TABLE 17

| | |
|---|---|
| Hydrogen | 0.6 wt % |
| Methane | 8.0 wt % |
| Ethylene | 16.3 wt % |
| Acetylene | 0.1 wt % |
| Ethane | 2.7 wt % |
| Propylene | 11.8 wt % |
| Propane | 0.5 wt % |
| Higher Molecular Weight Compounds | 60.0 wt % |

EXAMPLE 7

A Louisiana Crude Oil was fractionated to produce petroleum residuum, "Feed L". Feed L was processed in the hydrogenation chamber (without first deasphalting) of FIG. 2. Feed L was fed to the reactor at a rate of 2.9 kg per hour, which was equivalent to a 0.5 WHSV. Hydrogen was fed to the unit at a rate of 1.2 $m^3$/hr, equivalent to 404 $m^3$/tonne. The reactors external wall temperature was maintained at 369° C. throughout the run. The pressure of the reactor was controlled at 2,500 psig. The product from this unit (Feed M) was collected and used as feed for the thermal steam cracking apparatus. Analyses of Feed L and hydrogenated liquid product (Feed M) are given in Table 18.

TABLE 18

| | Feed L | Feed M |
|---|---|---|
| API gravity, ASTM D4052 | 28.5 | 30.7 |
| Sulfur, ASTM D2622 | 0.21 wt % | 0.01 wt % |
| Conradson Carbon ASTM D4530 | 1.0 wt % | 0.2 wt % |
| Hydrogen Content ASTM D4808 | 13.2 wt % | 13.6 wt % |
| Pentane Insolubles, ASTM D893 | 0.3 wt % | 0.2 wt % |
| Boiling Point Distribution | | |
| IBP–200° C. | 0 wt % | 0 wt % |
| 200–340° C. | 24.0 wt % | 10.0 wt % |
| 340–540° C. | 69.3 wt % | 83.3 wt % |
| 540–565° C. | 1.1 wt % | 2.5 wt % |
| 565–590° C. | 2.6 wt % | 1.8 wt % |
| 590–625° C. | 1.5 wt % | 0.7 wt % |
| 625–650° C. | 1.1 wt % | 0.7 wt % |
| 650+° C. | 0.4 wt % | 0.0 wt % |

About 7.1 percent of the short residuum contained in Feed L has a boiling point in excess of 650° C. Feed M was used as feed to the thermal steam cracking apparatus. The operation was carried out in the pilot plant equipment as depicted in FIG. 3 and as described previously. The olefin feedstream was metered at 3.6 kg/hr. The hydrocarbon was blended with 3.6 kg/hr steam (1.0 kg steam per kg feed) and the mixture was further heated to 523° C. The steam and oil flow rates were calculated to result in a 0.36 second residence time of the vapors in the cracking coil. The vapor stream was analyzed to determine the distribution of products as set forth in Table 19.

TABLE 19

| | |
|---|---|
| Hydrogen | 0.7 wt % |
| Methane | 12.4 wt % |
| Ethylene | 23.8 wt % |
| Acetylene | 0.3 wt % |
| Ethane | 3.6 wt % |
| Propylene | 12.1 wt % |
| Propane | 0.4 wt % |
| Higher Molecular Weight Compounds | 46.7 wt % |

EXAMPLE 8

A quantity of vacuum tower bottoms residuum was obtained from the Lyondell Citgo Refining Company. The boiling point distribution of this short residuum is given in Table 20:

TABLE 20

| Distillation Curve, ASTM D1160 | |
|---|---|
| Volume % Off | Temperature |
| IBP | 433° C. |
| 5% | 520° C. |
| 10% | 533° C. |
| 20% | 545° C. |
| 30% | 563° C. |
| 40% | 576° C. |
| 50% | 588° C. |
| 58% | 524° C. |
| 58–100% | Residue |

This short residuum was blended with the long residuum described in Example 2, and whose boiling point distribution are presented in Table 3. The blend was prepared by mixing one part (by weight) of the short residuum with two parts of the long residuum. The properties of the resulting mixture are given in Table 21 as Feed N.

TABLE 21

| | FEED N |
|---|---|
| API Gravity, ASTM D4052 | 19.1 |
| Sulfur, ASTM D2622 | 0.3 wt % |
| Conradson Carbon, ASTM D4530 | 6.8 wt % |
| Hydrogen Content, ASTM D4808 | 12.1 wt % |
| Pentane Insolubles, ASTM D893 | 4.2 wt % |

This blend was then deasphalted by solvent extraction with isobutane solvent at a treat rate of eight kg of solvent per kg of feed. The presence of short residuum improved the processability of the long residuum in the deasphalting unit. The deasphalted oil product (DAO) of this blend (Feed O) was used as feed to the hydrogenation chamber. The DAO was fed to the reactor at a rate of 3.0 kg per hour, which was equivalent to a 0.5 Weight Hourly Space Velocity (WHSV). Hydrogen was fed to the unit at a rate of 1.4 $m^3$/hr, equivalent to 464 $m^3$/tonne. A reactor outside wall temperature of 393° C. was maintained throughout the run. The pressure of the reactor was controlled at 2,800 psig. Analyses of the hydrotreater liquid feed and product (Feed P) are given in Table 22.

TABLE 22

| | Feed O | Feed P |
|---|---|---|
| API gravity, ASTM D4052 | 21.8 | 25.7 |
| Sulfur, ASTM D2622 | 0.27 wt % | <0.01 wt % |
| Conradson Carbon, ASTM D4530 | 3.3 wt % | 0.6 wt % |
| Hydrogen Content, ASTM 4808 | 12.4 wt % | 13.2 wt % |
| Pentane Insolubles, ASTM D893 | 0.2 wt % | 0.3 wt % |
| BOILING POINT DISTRIBUTIONS | | |
| IBP–200° C. | 0 wt % | 0 wt % |
| 200–340° C. | 2.6 wt % | 7.4 wt % |
| 340–540° C. | 53.9 wt % | 58.5 wt % |
| 540–565° C. | 7.8 wt % | 8.3 wt % |
| 565–590° C. | 10.1 wt % | 7.3 wt % |
| 590–625° C. | 9.2 wt % | 7.6 wt % |
| 625–650° C. | 5.3 wt % | 3.9 wt % |
| 650+° C. | 11.1 wt % | 7.0 wt % |

Figure 9:
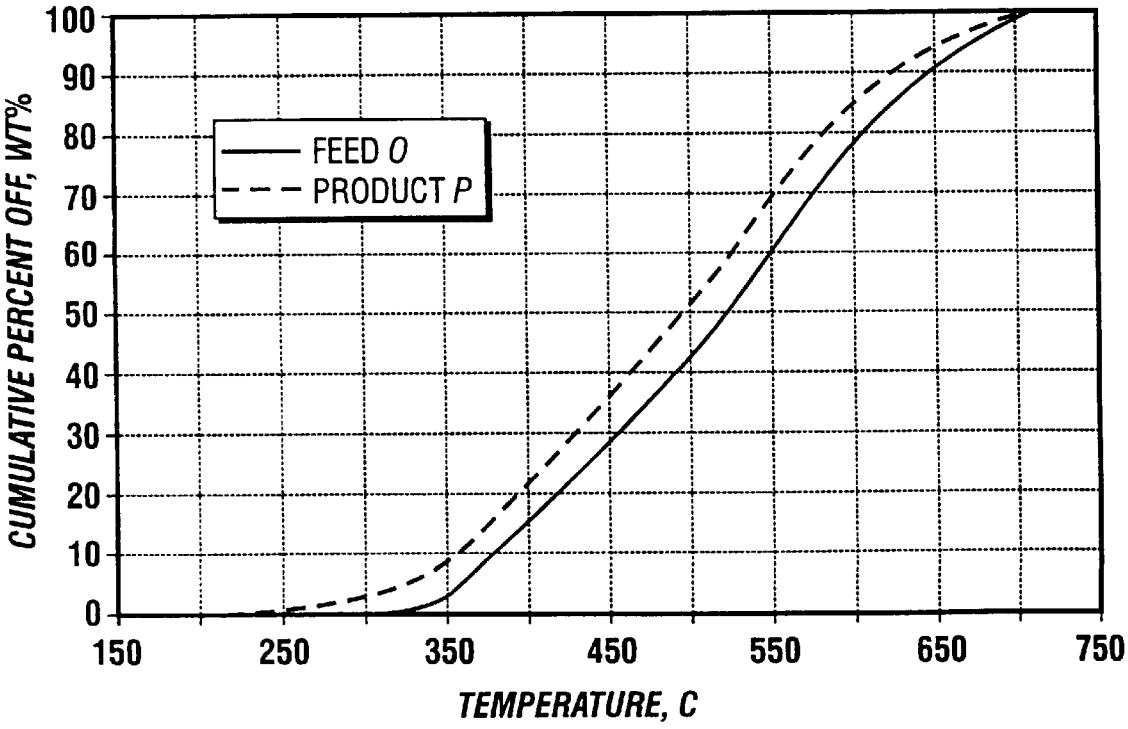
FIG. 9 is a boiling point distillation curve of a deasphalted blend of the crude of Example 2 with a commercially available vacuum residuum as described in Example 8.

The boiling point distribution for Feed O and Feed P are presented graphically in FIG. 9. About 31.1 and 27.1 percent of the short residuum contained in the Feed P and Product R, respectively, has a boiling point in excess of 650° C. This hydrotreated, deasphalted blend of short residuum and long residuum was then thermally steam cracked in the apparatus of FIG. 3. Hydrocarbon feed was metered at 3.6 kg/hr. The hydrocarbon wage blended with a 4.3 kg/hr steam (1.2 kg steam per kg feed) and the mixture was further heated to 523° C. The mixture was then fed to the thermal cracking tube that was maintained at 760° C. external wall temperature. The steam and oil flow rates were calculated to result in a 0.35 second residence time of the vapors in the cracking coil. The vapor stream was analyzed to determine the distribution of products shown in Table 23.

TABLE 23

| | |
|---|---|
| Hydrogen | 0.4 wt % |
| Methane | 8.1 wt % |
| Ethylene | 19.6 wt % |
| Acetylene | 0.2 wt % |
| Ethane | 2.9 wt % |
| Propylene | 12.9 wt % |
| Propane | 0.5 wt % |
| Higher Molecular Weight Compounds | 55.4 wt % |

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process which comprises:

(a) blending a long residuum feedstock with from about 20 to about 50 wt. %, based on the amount of blend, of a short residuum feedstock having a boiling point range from about 565° C. to about 750° C.;

(b) deasphalting the blend by solvent extraction to reduce the pentane insolubles of the blend to less than or equal to 1.2 (by ASTM D-893); and (c) thermally steam cracking the deasphalted blend to produce olefins.

2. The process of claim 1 wherein the deasphalted blend is hydrotreated to a hydrogen content greater than or equal to 12.5 wt. % prior to thermal steam cracking.

* * * * *